US010972824B1

(12) United States Patent
Tseng

(10) Patent No.: US 10,972,824 B1
(45) Date of Patent: Apr. 6, 2021

(54) WIRELESS EARPHONE

(71) Applicant: Merry Electronics (Shenzhen) Co., Ltd., ShenZhen (CN)

(72) Inventor: Yu-Kai Tseng, Taichung (TW)

(73) Assignee: Merry Electronics (Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 16/782,031

(22) Filed: Feb. 4, 2020

(30) Foreign Application Priority Data

Nov. 12, 2019 (TW) ..... 108140964

(51) Int. Cl.
*H04R 1/10* (2006.01)

(52) U.S. Cl.
CPC ..... *H04R 1/1016* (2013.01); *H04R 1/1041* (2013.01); *H04R 1/1058* (2013.01); *H04R 2420/07* (2013.01)

(58) Field of Classification Search
CPC . H04R 7/18; H04R 9/047; H04R 9/07; H04R 9/08; H04R 9/066; H04R 7/04; H04R 1/1016; H04R 9/06; H04R 1/1075; H04R 25/65; H04R 25/60; H04R 2225/51
USPC ..... 381/322, 324, 328
See application file for complete search history.

(56) References Cited

U.S. PATENT DOCUMENTS

2013/0278480 A1* 10/2013 McMilin ..... H01Q 1/243 343/904
2015/0049891 A1* 2/2015 Johnson ..... H01Q 1/273 381/315
2017/0149263 A1* 5/2017 Zhang ..... H02J 7/0045
2017/0180884 A1* 6/2017 Ozden ..... H04R 25/658
2018/0184191 A1* 6/2018 Kim ..... H04R 1/1041
2019/0022391 A1* 1/2019 Arfin ..... H04R 25/554

* cited by examiner

*Primary Examiner* — Alexander Krzystan
(74) *Attorney, Agent, or Firm* — JCIPRNET

(57) ABSTRACT

A wireless earphone including a top cover, a bottom cover, two rigid circuit boards, a flexible circuit board, and an antenna is provided. The bottom cover is connected to the top cover, and an inner chamber is formed between the top cover and the bottom cover. The two rigid circuit boards are disposed at intervals in the inner chamber. The flexible circuit board has a first connection part and a second connection part. Two ends of the first connection part are coupled to the two rigid circuit boards respectively. The second connection part is attached on at least one of the two rigid circuit boards. The antenna is coupled to a corresponding rigid circuit board to radiate a radio frequency signal. A coupling capacitor is formed at a parallel overlapping area between the second connection part and the rigid circuit board.

18 Claims, 7 Drawing Sheets

WIRELESS EARPHONE

CROSS-REFERENCE TO RELATED APPLICATION

This application claims the priority benefit of Taiwan application serial no. 108140964, filed on Nov. 12, 2019. The entirety of the above-mentioned patent application is hereby incorporated by reference herein and made a part of this specification.

BACKGROUND

Technical Field

The disclosure relates to a wireless earphone, in particular, to a wireless earphone capable of improving antenna operation bandwidth and radiation efficiency.

Description of Related Art

The existing wireless earphone has a main research and development direction of light weight and convenience. However, pattern routing of an antenna may be limited by a limited space inside the wireless earphone. Operation bandwidth and radiation efficiency of the antenna are relevant to an antenna dimension and an antenna ground plane. Too small antenna dimension and antenna ground plane may cause radiation performance worsening. Nowadays, through bending shaping of a flexible circuit board, an antenna ground plane dimension conforming to standards can be reached. However, inductive electronic wire distribution in the flexible circuit board is unfavorable for antenna radiation, so that severe attenuation during signal transmission is caused. An unstable connection condition between the wireless earphone and an electronic device may be caused by the attenuation of radio frequency signals, so that quality of the wireless earphone is influenced.

SUMMARY

The disclosure provides a wireless earphone. A coupling capacitor may be generated by combining a flexible circuit board and rigid circuit boards, and is configured to improve antenna operation bandwidth of the wireless earphone and radiation efficiency of an antenna.

The wireless earphone of the disclosure includes a top cover, a bottom cover, two rigid circuit boards, a flexible circuit board and an antenna. The bottom cover is connected to the top cover, and an inner chamber is formed between the top cover and the bottom cover. The two rigid circuit boards are disposed at intervals in the inner chamber. The flexible circuit board has a first connection part and a second connection part. Two ends of the first connection part are coupled to the two rigid circuit boards respectively. The second connection part is attached on at least one of the two rigid circuit boards. The antenna is coupled to the corresponding rigid circuit board to radiate a radio frequency signal. A coupling capacitor is formed at a parallel overlapping area between the second connection part and the rigid circuit board.

Based on the above, the flexible circuit board of the wireless earphone of the disclosure is disposed between the upper and lower rigid circuit boards. The flexible circuit board extends and is in contact with at least one of the rigid circuit boards and is insulated from the rigid circuit board. The coupling capacitor is formed at a mutual contact parallel overlapping area between the flexible circuit board and the rigid circuit board, and is configured to compensate an inductive effect of an electronic pattern of the flexible circuit board. An effect of improving the operation bandwidth and radiation efficiency of the antenna is achieved, and further, the wireless earphone of the disclosure reaches high-reliability wireless transmission quality.

Complementally, an added capacitance effect can effectively improve the radiation efficiency of the antenna of the wireless earphone. Therefore, an unstable connection condition between the wireless earphone and an external electronic device can be avoided.

To make the features and advantages of the disclosure clear and easy to understand, the following gives a detailed description of embodiments with reference to accompanying drawings.

DESCRIPTION OF THE EMBODIMENTS

Figure 1A:
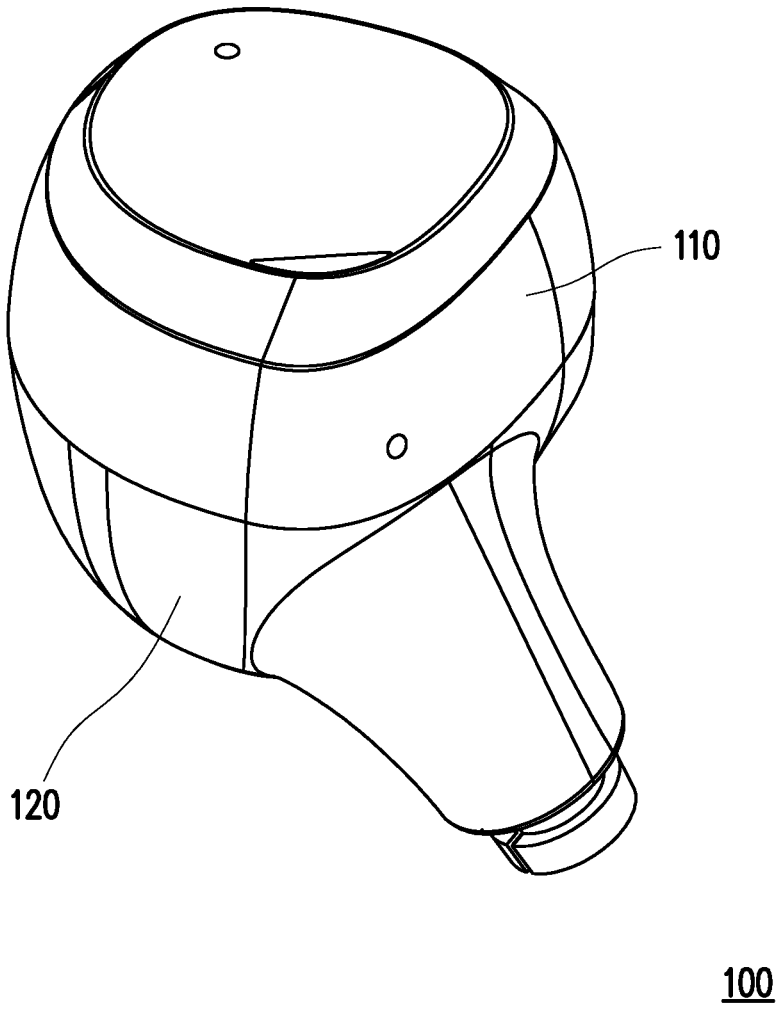
FIG. 1A is a schematic perspective view of a wireless earphone of an embodiment of the disclosure.
Figure 1B:
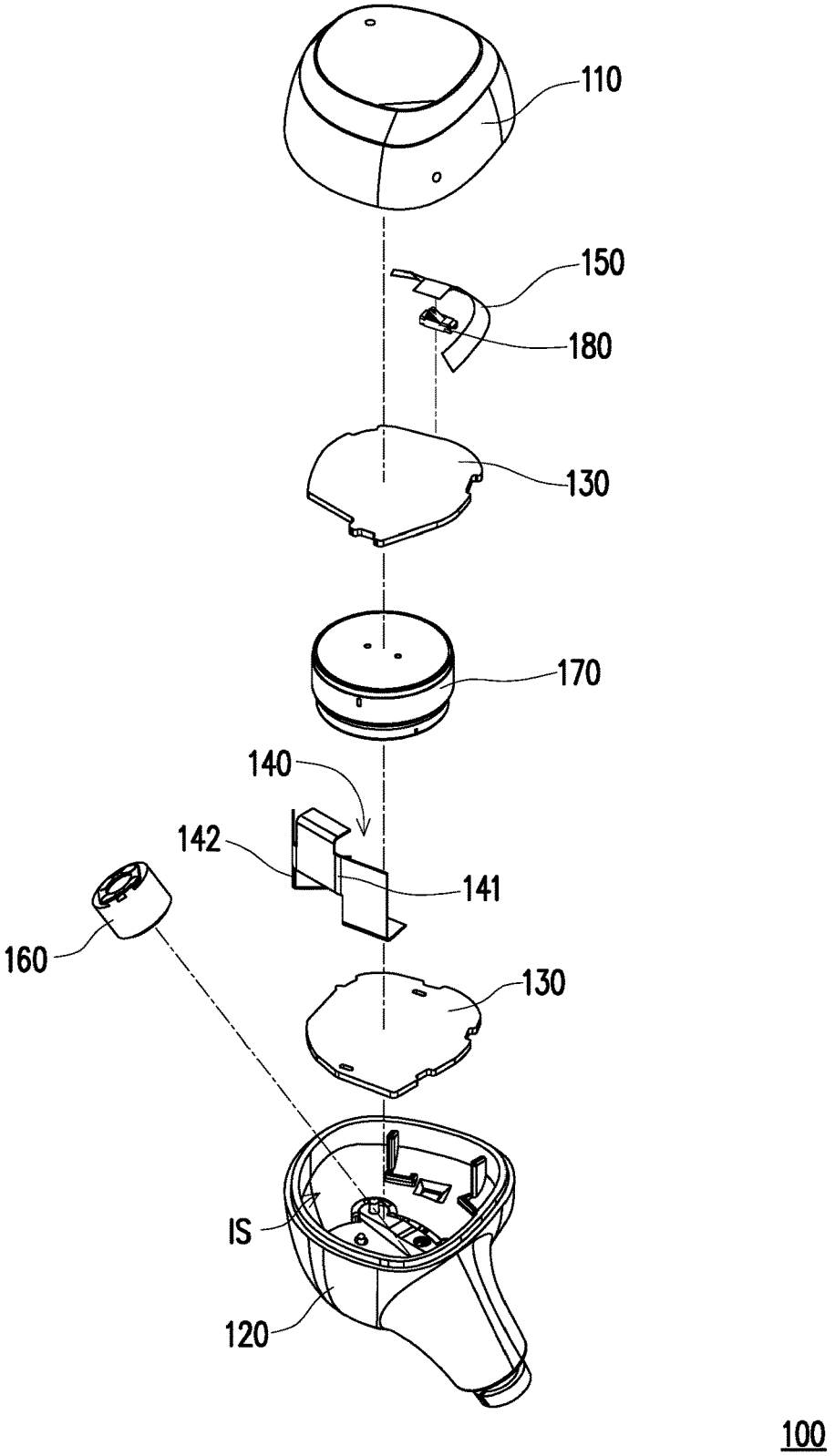
FIG. 1B is a schematic exploded view of elements of the wireless earphone in FIG. 1A.

FIG. 1A is a schematic perspective view of a wireless earphone of an embodiment of the disclosure. FIG. 1B is a schematic exploded view of elements of the wireless earphone in FIG. 1A.

Referring to FIG. 1A and FIG. 1B, a wireless earphone 100 of the disclosure is applicable to mutual wireless connection with an external electronic device (such as a smartphone, a tablet computer or other similar devices) through a wireless transmission technology (such as WIFI, Bluetooth or other similar technologies). The electronic device transmits a control instruction and audio data to the wireless earphone 100 through wireless transmission, so as to achieve goals of wireless control and audio output.

The wireless earphone 100 of the disclosure includes a top cover 110, a bottom cover 120, two rigid circuit boards 130, a flexible circuit board 140 and an antenna 150.

The bottom cover 120 is connected to the top cover 110. In the present embodiment, the bottom cover 120 and the top cover 110, for example, are mutually clamped and buckled, and an inner chamber IS is formed between the top cover 110 and the bottom cover 120. The two rigid circuit boards 130 are disposed at intervals in the inner chamber IS, and approach to the top cover 110 and the bottom cover 120 respectively. Complementally, the two rigid circuit boards 130 are configured to dispose metal circuits and other required electronic elements.

The flexible circuit board 140 has a first connection part 141 and a second connection part 142. Two ends of the first connection part 141 are coupled to the two rigid circuit boards 130 respectively. The second connection part 142 is attached on at least one of the two rigid circuit boards 130. Referring to FIG. 1B, the second connection part 142 of the flexible circuit board 140 of the present embodiment is attached on one of the rigid circuit boards 130 positioned in the bottom cover 120.

An antenna 150 is coupled to a corresponding rigid circuit board 130 to radiate a radio frequency signal. In the present embodiment, the antenna 150 is disposed on the top cover 110. In other embodiments, the antenna 150 may also be disposed on the bottom cover 120, and this depends on requirements. Further, the antenna, for example, includes a monopole antenna, an inverted-F antenna, a loop antenna or other kinds of antennas, wherein the antenna may be made through laser forming or in a flexible printed circuit board form.

The second connection part 142 and the contact rigid circuit board 130 are not mutually conducted, so that a coupling capacitor is formed at a parallel overlapping area OA between the second connection part 142 and the rigid circuit board 130.

Figure 2A:
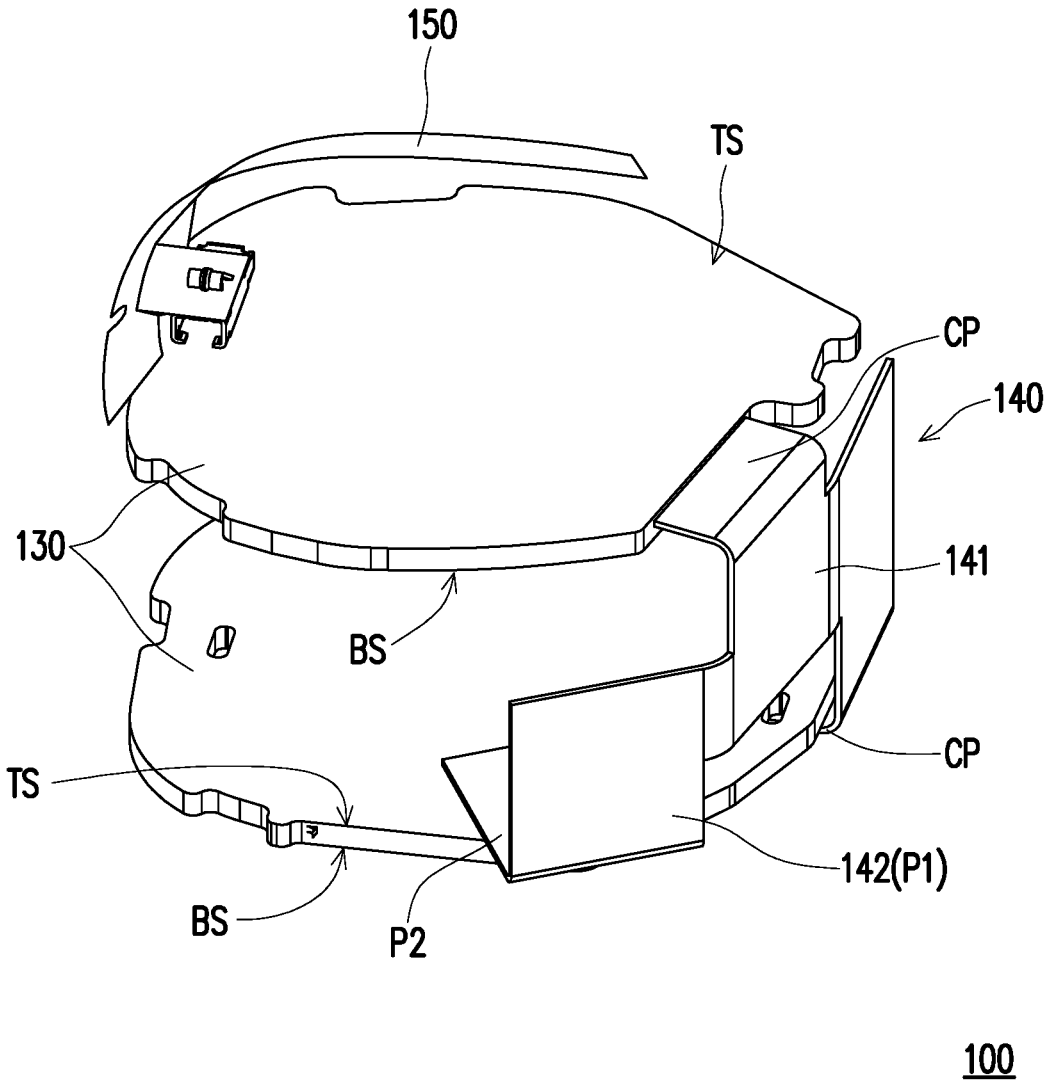
FIG. 2A is a schematic view of connection of rigid circuit boards, a flexible circuit board and an antenna of the wireless earphone in FIG. 1B.
Figure 2B:
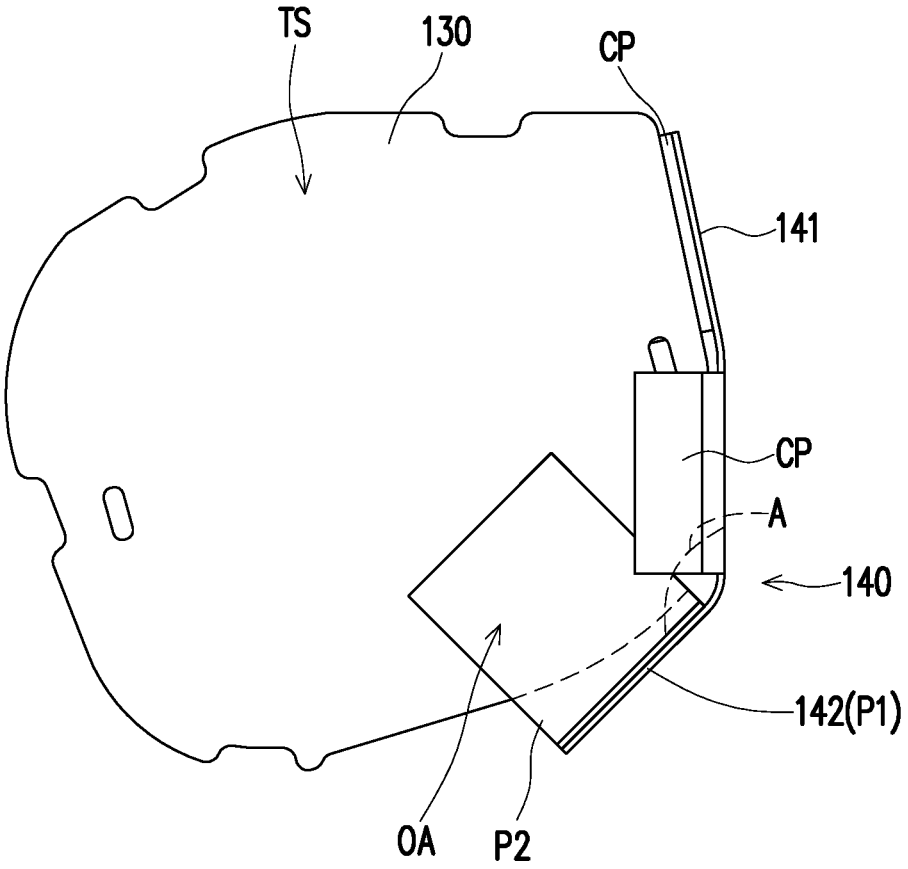
FIG. 2B is a top view of one of the rigid circuit boards and the flexible circuit board positioned in a bottom cover in FIG. 1B.
Figure 2C:
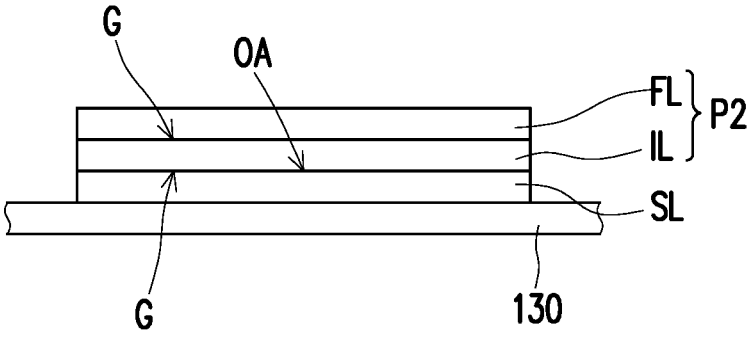
FIG. 2C is a detailed schematic structural view of the flexible circuit board and the rigid circuit boards of the wireless earphone in FIG. 1B.

FIG. 2A is a schematic view of connection of rigid circuit boards, a flexible circuit board and an antenna of the wireless earphone in FIG. 1B. FIG. 2B is a top view of one of the rigid circuit boards 130 and the flexible circuit board positioned in the bottom cover 120 in FIG. 1B. FIG. 2C is a detailed schematic structural view of the flexible circuit board and the rigid circuit boards of the wireless earphone in FIG. 1B.

Referring to FIG. 1B, FIG. 2A and FIG. 2B, the first connection part 141 of the flexible circuit board 140 includes two channel branch sections CP. The two channel branch sections CP are coupled to the two rigid circuit boards 130 respectively. Detailedly, each channel branch section CP is applicable to extend from a lateral edge of each rigid circuit board 130, so that the two rigid circuit boards 130 can be mutually and electrically conducted, wherein a connection condition of each channel branch section CP and each rigid circuit board 130 may be freely regulated according to the design requirements of the wireless earphone 100.

The second connection part 142 of the flexible circuit board 140 includes a central branch section P1 and a lower branch section P2. The central branch section P1 is partially connected with the first connection part 141 and extends towards the bottom cover 120. The lower branch section P2 vertically extends from the central branch section P1 and is parallel to the corresponding rigid circuit board 130. The lower branch section P2 is partially overlapped on an upper surface TS of the rigid circuit board 130. In other embodiments, the lower branch section P2 may also be partially overlapped on a lower surface BS of the rigid circuit board 130. The disclosure is not limited thereto.

Referring to FIG. 2C, the lower branch section P2 has a first metal layer FL and an insulation film layer IL. The first metal layer FL faces one of the rigid circuit boards 130. The insulation film layer IL is disposed outside the first metal layer FL so as to cover the first metal layer FL. One of the rigid circuit boards 130 has a second metal layer SL, and the insulation film layer IL is positioned between the first metal layer FL and the second metal layer SL so as to form a coupling capacitor.

In other embodiments, an insulation film layer is, for example, disposed on a second metal layer of the rigid circuit board so as to cover the second metal layer, and is positioned between the first metal layer and the second metal layer so as to form a coupling capacitor. The insulation film layers are, for example, disposed on a first metal layer of the lower branch section and a second metal layer of the rigid circuit board respectively so as to cover the first metal layer and the second metal layer, and are positioned between the first metal layer and the second metal layer so as to form a coupling capacitor.

Detailedly, the insulation film layer IL is disposed between the first metal layer FL of the lower branch section P2 and the second metal layer SL of one of the rigid circuit boards 130, so that the lower branch section P2 and the rigid circuit board 130 are electrically insulated. The first metal layer FL and the second metal layer SL are in contact with upper and lower sides of the insulation film layer IL respectively to form a ground plane G, so that a coupling capacitor is formed in an overlapping area OA of the first metal layer FL, the insulation film layer IL and the second metal layer SL, and is configured to compensate an inductive effect of the flexible circuit board 140.

Referring to FIG. 2A and FIG. 2B, in the present embodiment, an area of the overlapping area OA between the lower branch section P2 and the rigid circuit board 130 is 2 mm*4.5 mm, and the area is a proper size for forming the effective coupling capacitor. An included angle A between the first connection part 141 and the second connection part 142 of the flexible circuit board 140 is greater than 90 degrees, and is preferably 135 degrees. In other embodiments, the overlapping area OA and the included angle A can be correspondingly regulated according to the design requirements or a dimension of the wireless earphone, and the disclosure is not limited thereto.

Referring to FIG. 1A, FIG. 1B and FIG. 2A, further, the wireless earphone 100 also includes a loudspeaker unit 160, a power supply unit 170 and a connection piece 180.

The loudspeaker unit 160 is disposed in the bottom cover 120, is coupled to one of the rigid circuit boards 130, and is configured to convert digital audio into analog sound and transmit the analog sound into human ears. The power supply unit 170 is, for example, a rechargeable battery disposed between the two rigid circuit boards 130, is mutually and electrically coupled with the two rigid circuit boards, and is configured to provide electric power required for operation of the wireless earphone 100. The connection piece 180 is disposed on the corresponding rigid circuit board 130.

The antenna 150 is coupled to the rigid circuit board 130 through the connection piece 180 and bends and extends along an inner side surface of the top cover 110, and the antenna 150 is suitable for being attached on the inner side surface of the top cover 110 so as to save space. In other embodiments, the antenna bends and extends along an outer side surface of the top cover 110 and is suitable for being attached on the outer side surface of the top cover so that the antenna cannot be blocked by the top cover.

Further, the wireless earphone 100 also includes a support piece disposed between the two rigid circuit boards 130. The flexible circuit board 140 is attached on an outer surface of the support piece, and the support piece is electrically insulated.

Figure 3A:
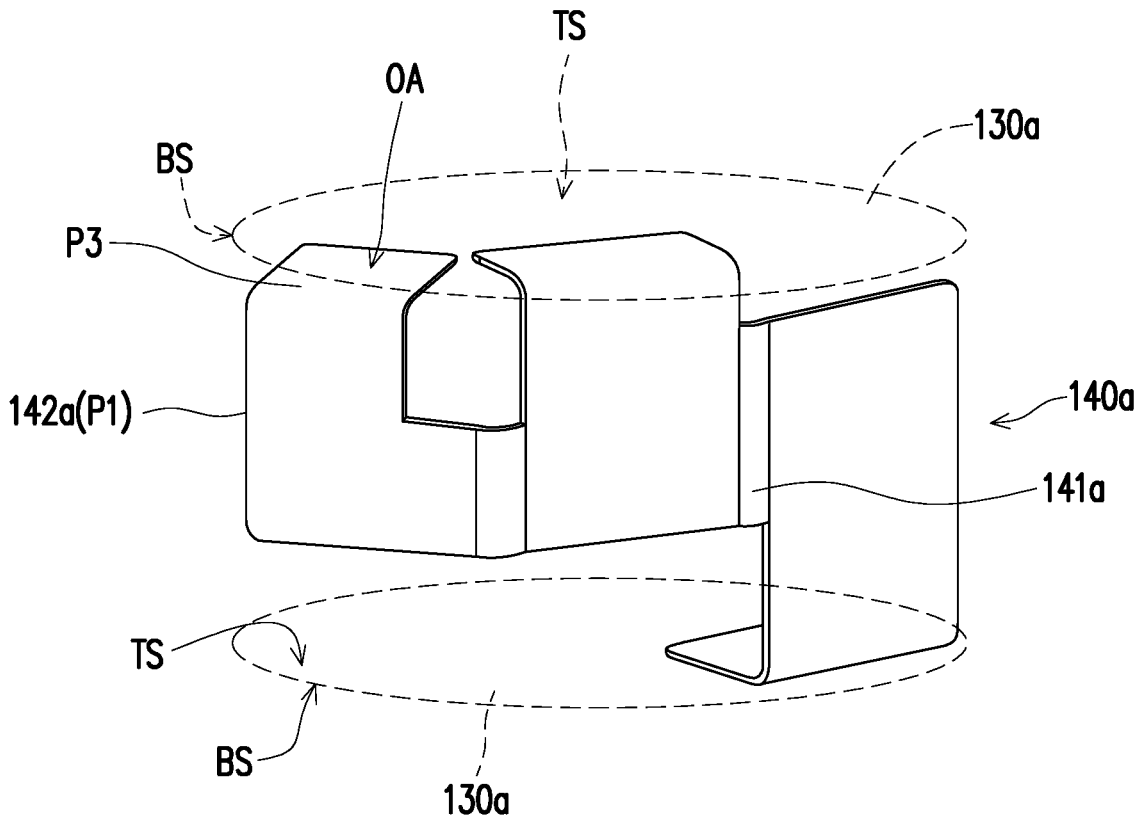
FIG. 3A is a schematic perspective view of a flexible circuit board of the wireless earphone of the disclosure using another embodiment.
Figure 3B:
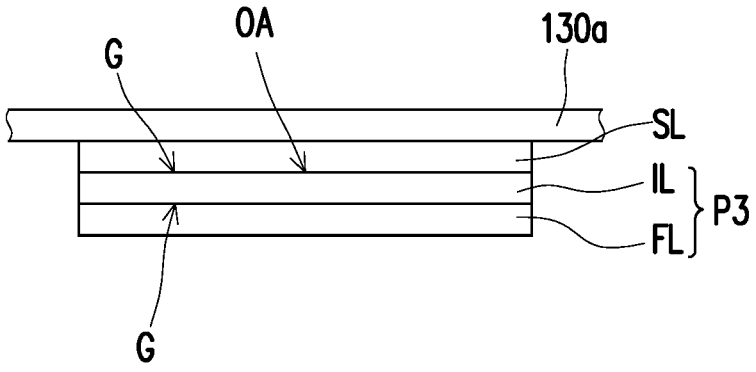
FIG. 3B is a detailed schematic structural view of the flexible circuit board and rigid circuit boards in FIG. 3A.

FIG. 3A is a schematic perspective view of a flexible circuit board of the wireless earphone of the disclosure using another embodiment. FIG. 3B is a detailed schematic structural view of the flexible circuit board and rigid circuit boards in FIG. 3A.

Referring to FIG. 2A and FIG. 3A, the wireless earphone of the present embodiment uses a flexible circuit board 140*a* of another embodiment. The difference is that a second connection part 142*a* of the flexible circuit board 140*a* includes a central branch section P1 and an upper branch section P3. The central branch section P1 is partially connected with the first connection part 141*a* and extends towards the top cover 110. The upper branch section P3 vertically extends from the central branch section P1 and is parallel to the corresponding rigid circuit board 130*a*. The upper branch section P3 is partially overlapped on an upper surface TS or a lower surface BS of the rigid circuit board 130*a*.

Referring to FIG. 3A and FIG. 3B, the upper branch section P3 has an insulation film layer IL and a first metal layer FL. The insulation film layer IL is disposed outside the first metal layer FL. The rigid circuit board 130*a* has a second metal layer SL. The insulation film layer IL is positioned between the first metal layer FL and the second metal layer SL so as to form the coupling capacitor.

Detailedly, the insulation film layer IL is disposed between the first metal layer FL of the upper branch section P3 and the second metal layer SL of the rigid circuit board 130*a*, so that the upper branch section P3 and the rigid circuit board 130*a* are electrically insulated. The first metal layer FL and the second metal layer SL are in contact with the upper and the lower sides of the insulation film layer IL respectively to form a ground plane G, so that a coupling capacitor is formed in the overlapping area OA of the first metal layer FL, the insulation film layer IL and the second metal layer SL, and is configured to compensate an inductive effect of the flexible circuit board 140*a*.

In other embodiments, an insulation film layer is, for example, disposed on a second metal layer of the rigid circuit board so as to cover the second metal layer. The insulation film layer is positioned between the first metal layer and the second metal layer so as to form a coupling capacitor. The insulation film layers are, for example, disposed on the first metal layer of the upper branch section and the second metal layer of the rigid circuit board so as to cover the first metal layer and the second metal layer, and are positioned between the first metal layer and the second metal layer so as to form a coupling capacitor.

Figure 4A:
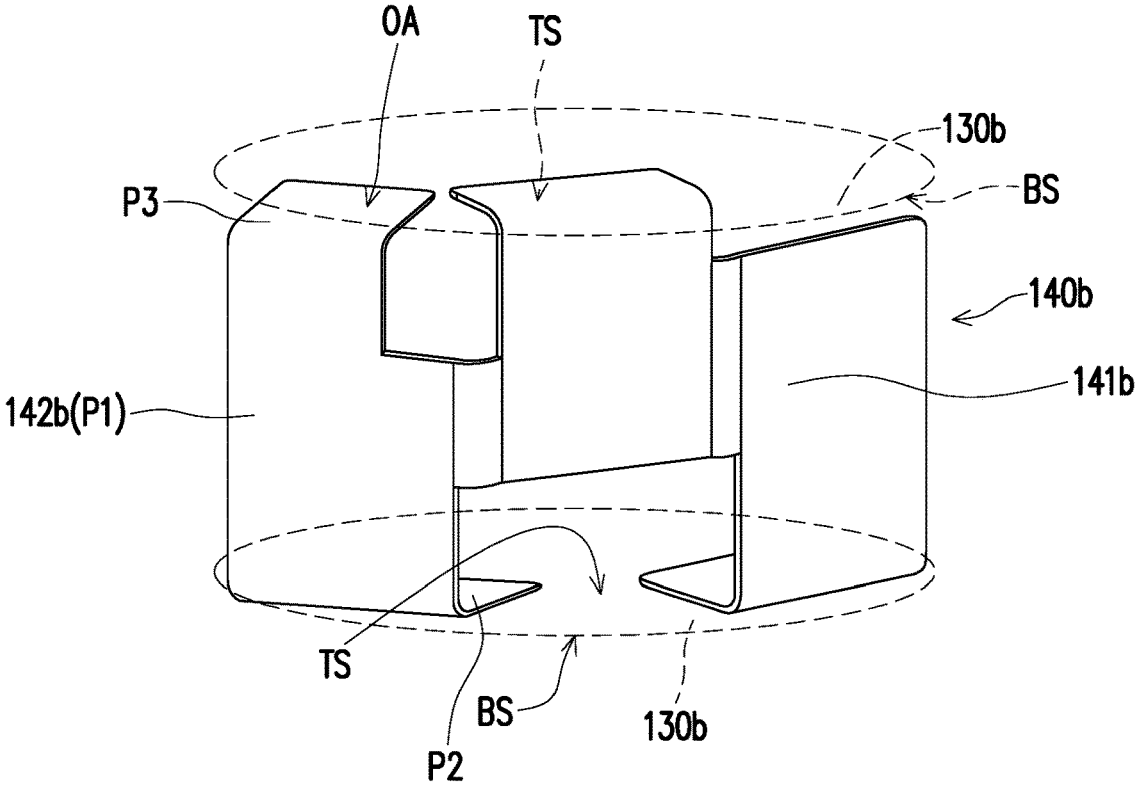
FIG. 4A is a schematic perspective view of a flexible circuit board of the wireless earphone of the disclosure using yet another embodiment.
Figure 4B:
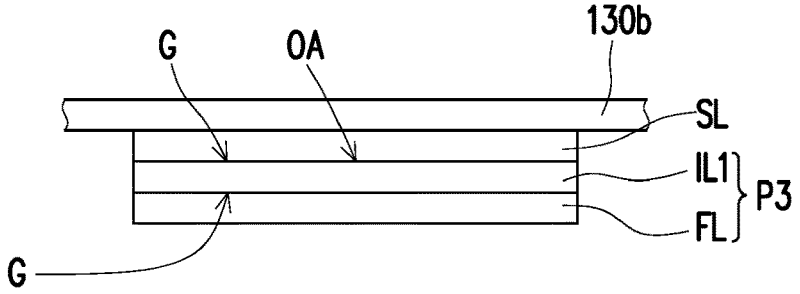
FIG. 4B and FIG. 4C are detailed schematic structural views of the flexible circuit board and two rigid circuit boards in FIG. 4A respectively.
Figure 4C:
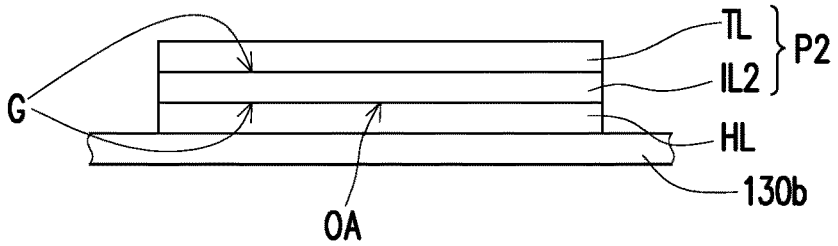

FIG. 4A is a schematic perspective view of a flexible circuit board of the wireless earphone of the disclosure using yet another embodiment. FIG. 4B and FIG. 4C are detailed schematic structural views of the flexible circuit board and two rigid circuit boards in FIG. 4A respectively.

Referring to FIG. 2A and FIG. 4A, the wireless earphone of the present embodiment uses a flexible circuit board 140*b* of the yet another embodiment. A second connection part 142*b* of the flexible circuit board 140*b* includes a central branch section P1, a lower branch section P2 and an upper branch section P3.

The central branch section P1 is partially connected with the first connection part 141*b* and extends towards the top cover 110 and the bottom cover 120 respectively. The upper branch section P3 and the lower branch section P2 vertically extend from two ends of the central branch section P1 respectively and are parallel to the two rigid circuit boards 130*b* respectively. The upper branch section P3 is partially overlapped on an upper surface TS or a lower surface BS of one of the rigid circuit boards 130*b*. The lower branch section P2 is partially overlapped on an upper surface TS or a lower surface BS of the other one of the rigid circuit boards 130*b*.

Referring to FIG. 4A to FIG. 4C, the upper branch section P3 has a first insulation film layer IL1 and a first metal layer FL. The first insulation film layer IL1 is disposed outside the first metal layer FL. One of the rigid circuit boards 130*b* has a second metal layer SL. The first insulation film layer IL1 is positioned between the first metal layer FL and the second metal layer SL so as to form a coupling capacitor (as shown in FIG. 4B).

Detailedly, the first insulation film layer IL1 is disposed between the first metal layer FL of the upper branch section P3 and the second metal layer SL of the rigid circuit board 130*b*, so that the upper branch section P3 and the rigid circuit board 130*b* are electrically insulated. The first metal layer FL and the second metal layer SL are in contact with upper and lower sides of the first insulation film layer IL1 respectively to form a ground plane G, so that a coupling capacitor is formed at an overlapping area OA of the first metal layer FL, the first insulation film layer IL1 and the second metal layer SL.

In other embodiments, a first insulation film layer is, for example, disposed on a second metal layer of one of the rigid circuit boards so as to cover the second metal layer. The first insulation film layer is positioned between the first metal layer and the second metal layer so as to form a coupling capacitor. The first insulation film layers are, for example, disposed on the first metal layer of the upper branch section and the second metal layer of one of the rigid circuit boards so as to cover the first metal layer and the second metal layer, and are positioned between the first metal layer and the second metal layer so as to form a coupling capacitor.

The lower branch section P2 has a second insulation film layer IL2 and a third metal layer TL. The second insulation film layer IL2 is disposed outside the third metal layer TL. The other one of the rigid circuit boards 130*b* has a fourth metal layer HL. The second insulation film layer IL2 is positioned between the third metal layer TL and the fourth metal layer HL so as to form another coupling capacitor (as shown in FIG. 4C).

Detailedly, the second insulation film layer IL2 is disposed between the third metal layer TL of the lower branch section P2 and a fourth metal layer HL of one of the rigid circuit boards 130*b*, so that the lower branch section P2 and the rigid circuit board 130*b* are electrically insulated. The third metal layer TL and the fourth metal layer HL are in contact with upper and lower side surfaces of the second insulation film layer IL2 respectively to form a ground plane G, so that a coupling capacitor is formed at an overlapping area OA of the third metal layer TL, the second insulation film layer IL2 and the fourth metal layer HL.

In other embodiments, a second insulation film layer is, for example, disposed on the other one of the rigid circuit boards so as to cover a fourth metal layer, and the second insulation film layer is positioned between the third metal layer and the fourth metal layer so as to form a coupling capacitor. The second insulation film layers are, for example, disposed on the third metal layer of the lower branch section and the fourth metal layer of the other one of the rigid circuit boards respectively so as to cover the third metal layer and the fourth metal layer, and are positioned between the third metal layer and the fourth metal layer so as to form a coupling capacitor.

Briefly, compared with the embodiments in FIG. 2A and FIG. 3A, the embodiment in FIG. 4A forms the coupling capacitors on the two rigid circuit boards respectively.

Figure 5:
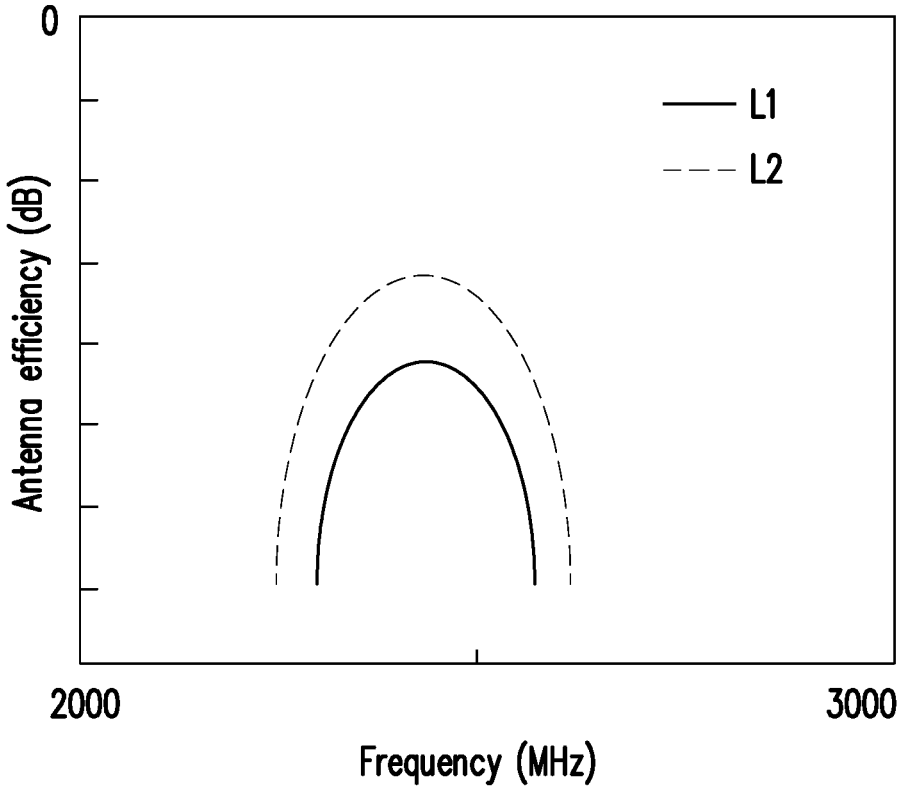
FIG. 5 is an antenna efficiency diagram of the wireless earphone of the disclosure.

FIG. 5 is an antenna efficiency diagram of the wireless earphone of the disclosure. Referring to FIG. 5, a line section L2 is a frequency response of antenna efficiency of the wireless earphone 100 of the disclosure. A line section L1 is a frequency response of antenna efficiency of an existing wireless earphone. The antenna efficiency of the line section L2 is closer to 0 dB than that of the line section L1, which shows that a signal attenuation degree of the line section L2 is lower, and wireless transmission quality is higher.

In conclusion, a flexible circuit board of the wireless earphone of the disclosure is disposed between upper and lower rigid circuit boards. The flexible circuit board extends and is in contact with at least one of the rigid circuit boards and is insulated from the rigid circuit board. A coupling capacitor is formed at a mutual contact parallel overlapping area between the flexible circuit board and the rigid circuit board, and is configured to compensate an inductive effect of an electronic pattern of the flexible circuit board. An effect of operation bandwidth and radiation efficiency of a radio antenna is improved, and further the wireless earphone of the disclosure reaches high-reliability wireless transmission quality.

Complementally, an added capacitance effect can effectively improve the radiation efficiency of the antenna of the wireless earphone. Therefore, an unstable connection condition between the wireless earphone and an external electronic device can be avoided.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A wireless earphone, comprising:

a top cover;

a bottom cover, connected to the top cover, wherein an inner chamber is formed between the top cover and the bottom cover;

two rigid circuit boards, disposed at intervals in the inner chamber;

a flexible circuit board, having a first connection part and a second connection part, wherein two ends of the first connection part are coupled to the two rigid circuit boards respectively, and the second connection part is attached on at least one of the two rigid circuit boards; and an antenna, coupled to the corresponding rigid circuit board to radiate a radio frequency signal, wherein a coupling capacitor is formed at a parallel overlapping area between the second connection part and the rigid circuit board.

2. The wireless earphone according to claim 1, wherein the second connection part comprises a central branch section and a lower branch section, wherein the central branch section is partially connected with the first connection part and extends towards the bottom cover; the lower branch section vertically extends from the central branch section and is parallel to the corresponding rigid circuit board; and the lower branch section is partially overlapped on an upper surface or a lower surface of the rigid circuit board.

3. The wireless earphone according to claim 2, wherein the lower branch section has an insulation film layer and a first metal layer, wherein the insulation film layer is disposed outside the first metal layer; the rigid circuit board has a second metal layer; and the insulation film layer is positioned between the first metal layer and the second metal layer so as to form the coupling capacitor.

4. The wireless earphone according to claim 2, further comprising an insulation film layer, wherein the insulation film layer is disposed on a second metal layer of the rigid circuit board so as to cover the second metal layer; the lower branch section has a first metal layer; and the insulation film layer is positioned between the first metal layer and the second metal layer so as to form the coupling capacitor.

5. The wireless earphone according to claim 2, further comprising two insulation film layers disposed on a first metal layer of the lower branch section and a second metal layer of the rigid circuit board respectively so as to cover the first metal layer and the second metal layer, wherein the two insulation film layers are positioned between the first metal layer and the second metal layer so as to form the coupling capacitor.

6. The wireless earphone according to claim 1, wherein the second connection part comprises a central branch section and an upper branch section, wherein the central branch section is partially connected with the first connection part and extends towards the top cover; the upper branch section vertically extends from the central branch section and is parallel to the corresponding rigid circuit board; and the upper branch section is partially overlapped on an upper surface or a lower surface of the rigid circuit board.

7. The wireless earphone according to claim 6, wherein the upper branch section has an insulation film layer and a first metal layer, wherein the insulation film layer is disposed outside the first metal layer; the rigid circuit board has a second metal layer; and the insulation film layer is positioned between the first metal layer and the second metal layer so as to form the coupling capacitor.

8. The wireless earphone according to claim 6, further comprising an insulation film layer disposed on a second metal layer of the rigid circuit board so as to cover the second metal layer, wherein the upper branch section has a first metal layer, and the insulation film layer is positioned between the first metal layer and the second metal layer so as to form the coupling capacitor.

9. The wireless earphone according to claim 6, further comprising two insulation film layers disposed on a first metal layer of the upper branch section and a second metal layer of the rigid circuit board respectively so as to cover the first metal layer and the second metal layer, wherein the two insulation film layers are positioned between the first metal layer and the second metal layer so as to form the coupling capacitor.

10. The wireless earphone according to claim 1, wherein the second connection part comprises a central branch section, an upper branch section and a lower branch section, wherein the central branch section is partially connected with the first connection part and extends towards the top cover and the bottom cover respectively; the upper branch section and the lower branch section vertically extend from two ends of the central branch section respectively and are parallel to the two rigid circuit boards respectively; the upper branch section is partially overlapped on an upper surface or a lower surface of one of the two rigid circuit boards; and the lower branch section is partially overlapped on an upper surface or a lower surface of the other one of the two rigid circuit boards.

11. The wireless earphone according to claim 10, wherein the upper branch section has a first insulation film layer and a first metal layer, wherein the first insulation film layer is disposed outside the first metal layer, one of the two rigid circuit boards has a second metal layer, and the first insulation film layer is positioned between the first metal layer and the second metal layer so as to form the coupling capacitor; and the lower branch section has a second insulation film layer and a third metal layer, wherein the second insulation film layer is disposed outside the third metal layer, the other one of the two rigid circuit boards has a fourth metal layer, and the second insulation film layer is positioned between the third metal layer and the fourth metal layer so as to form the coupling capacitor.

12. The wireless earphone according to claim 10, further comprising a first insulation film layer and a second insulation film layer, wherein the first insulation film layer is disposed on a second metal layer of one of the two rigid circuit boards so as to cover the second metal layer, the upper branch section has a first metal layer, and the first insulation film layer is positioned between the first metal layer and the second metal layer so as to form the coupling capacitor; and the second insulation film layer is disposed on a fourth metal layer of the other one of the two rigid circuit boards so as to cover the fourth metal layer, the lower branch section has a third metal layer, and the second insulation film layer is positioned between the third metal layer and the fourth metal layer so as to form the coupling capacitor.

13. The wireless earphone according to claim 10, further comprising a first insulation film layer and a second insulation film layer, wherein the first insulation film layer is disposed on a first metal layer of the upper branch section and a second metal layer of one of the two rigid circuit boards respectively so as to cover the first metal layer and the second metal layer, and the first insulation film layer is positioned between the first metal layer and the second metal layer so as to form the coupling capacitor; and the second insulation film layer is disposed on a third metal layer of the lower branch section and a fourth metal layer of the other one of the two rigid circuit boards respectively so as to cover the third metal layer and the fourth metal layer, and the second insulation film layer is positioned between the third metal layer and the fourth metal layer so as to form the coupling capacitor.

14. The wireless earphone according to claim 1, further comprising a connection piece disposed on the corresponding rigid circuit board, wherein the antenna is coupled to the rigid circuit board through the connection piece, and extends along an inner side surface or an outer side surface of the top cover, and the antenna is attached on the inner side surface or the outer side surface.

15. The wireless earphone according to claim 1, further comprising a support piece disposed between the two rigid circuit boards, wherein the flexible circuit board is attached on an outer surface of the support piece, and the support piece is electrically insulated.

16. The wireless earphone according to claim 1, wherein an area of the overlapping area is 2 mm*4.5 mm.

17. The wireless earphone according to claim 1, wherein an included angle between the first connection part and the second connection part is greater than 90 degrees.

18. The wireless earphone according to claim 1, wherein an included angle between the first connection part and the second connection part is 135 degrees.

* * * * *